US007784795B1

(12) United States Patent
Liao

(10) Patent No.: US 7,784,795 B1
(45) Date of Patent: Aug. 31, 2010

(54) FOLDABLE TOSS GAME ASSEMBLY

(76) Inventor: Grace Liao, 7F., No. 20, Sec. 1, HePing W. Rd., JhongJheng District, Taipei City (TW)

( * ) Notice: Subject to any disclaimer, the term of this patent is extended or adjusted under 35 U.S.C. 154(b) by 0 days.

(21) Appl. No.: 12/466,375

(22) Filed: May 14, 2009

(51) Int. Cl.
*A63B 63/00* (2006.01)

(52) U.S. Cl. ..... 273/400

(58) Field of Classification Search ..... 273/398–402; 473/476–478

See application file for complete search history.

(56) References Cited

U.S. PATENT DOCUMENTS 715,249 A * 12/1902 Dunbar ..... 273/401
1,812,677 A * 6/1931 Bergquist ..... 273/399
5,332,230 A * 7/1994 Benedict ..... 473/594
5,524,901 A * 6/1996 Bison et al. ..... 473/197
5,549,304 A * 8/1996 Davis ..... 273/396
5,722,446 A * 3/1998 Zheng ..... 135/125
6,514,149 B2 * 2/2003 Yoon ..... 473/197
6,939,241 B1 * 9/2005 Chang ..... 473/197
6,991,567 B2 * 1/2006 Wong et al. ..... 473/478
7,198,274 B2 * 4/2007 Cho ..... 273/400
7,311,617 B2 * 12/2007 Langhorn ..... 473/446
2009/0096171 A1 * 4/2009 Simon ..... 273/400

* cited by examiner

*Primary Examiner*—Mark S Graham

(57) ABSTRACT

A foldable toss game assembly includes two toss surfaces. Each toss surface has a memory ring on the border, and each toss surface includes at least a hollow toss target area surrounded by a surrounding net. The two toss surfaces are connected by a plurality of connection parts with different sizes to form a three-dimensional structure with a slanted surface. The connection parts can be engaged or disengaged so that the foldable toss game can be easily set up for play or folded for carrying and storage.

8 Claims, 6 Drawing Sheets

FOLDABLE TOSS GAME ASSEMBLY

FIELD OF THE INVENTION

The present invention generally relates to a foldable toss game assembly, and more specifically to a foldable toss game assembly having more than one toss target area of different arrangement, and easy to assemble and store.

BACKGROUND OF THE INVENTION

The popular bean bag game and washer toss are both foldable toss game assemblies for tossing an object into a target area. By arranging the locations and the shapes of the target areas, the player can toss the object into the target areas.

For bean bag game, the assembly is usually a three-dimensional structure with a slanted surface made of a wood board. The slanted surface includes a plurality of target holes of different shapes and at different locations. The slant surface can be decorated with different patterns, logos, showing scores, and so on. The player must toss the objects with shape matching the shape of target holes into the match target holes.

The bean bag game has used on one side of surface for toss target areas. By repeatedly tossing the objects into the familiar target holes, the players can be easily bored by the repetition. In addition, because the assembly must be able to endure the impact of the tossed object to avoid tipping over or shifting, the assembly is usually made of wood to increase the weight and in a three-dimensional structure, rendering the assembly inconvenient for carrying and storage.

SUMMARY OF THE INVENTION

The primary object of the present invention is to provide a toss game assembly to overcome the aforementioned disadvantages of the conventional toss game assemblies, such as, monotonic playing mode, inconvenient for carrying and storage.

The main feature of the present invention is the inclusion of more than one arrangement of the target areas to provide the player with more varieties of toss targets to increase the fun of the game.

Another feature of the present invention is that the assembly of the present invention is light in weight and easy for carrying, setting up and storage.

To achieve the above objects, the present invention provides two toss surfaces. Each toss surface includes a memory ring located at the border. Each toss surface includes at least a hollow toss target area. The toss target area is surrounded by a surrounding net. A plurality of connection parts is included between the two memory rings to form a three-dimensional foldable toss game assembly with a slanted surface.

One toss surface of the present invention includes a target area and the other toss surface of the present invention includes a plurality of toss areas so that the player can choose to play on one surface. The toss surfaces and the connection parts are manufactured with plastic cloth to reduce the weight. The connection parts and one of the toss surfaces are connected with touch fasteners. When not in use, the touch fasteners can be disengaged so that the two toss surfaces can overlap to reduce the volume. In addition, with the bendable memory rings, the toss surfaces can be folded to the minimum size to further reduce the volume. To play the present invention, the toss surfaces can be unfolded, engaged by the connection parts to form the three-dimensional structure again. Therefore, the structure of the present invention achieves the objects of light weight, ease of carrying and storage.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

Figure 1:
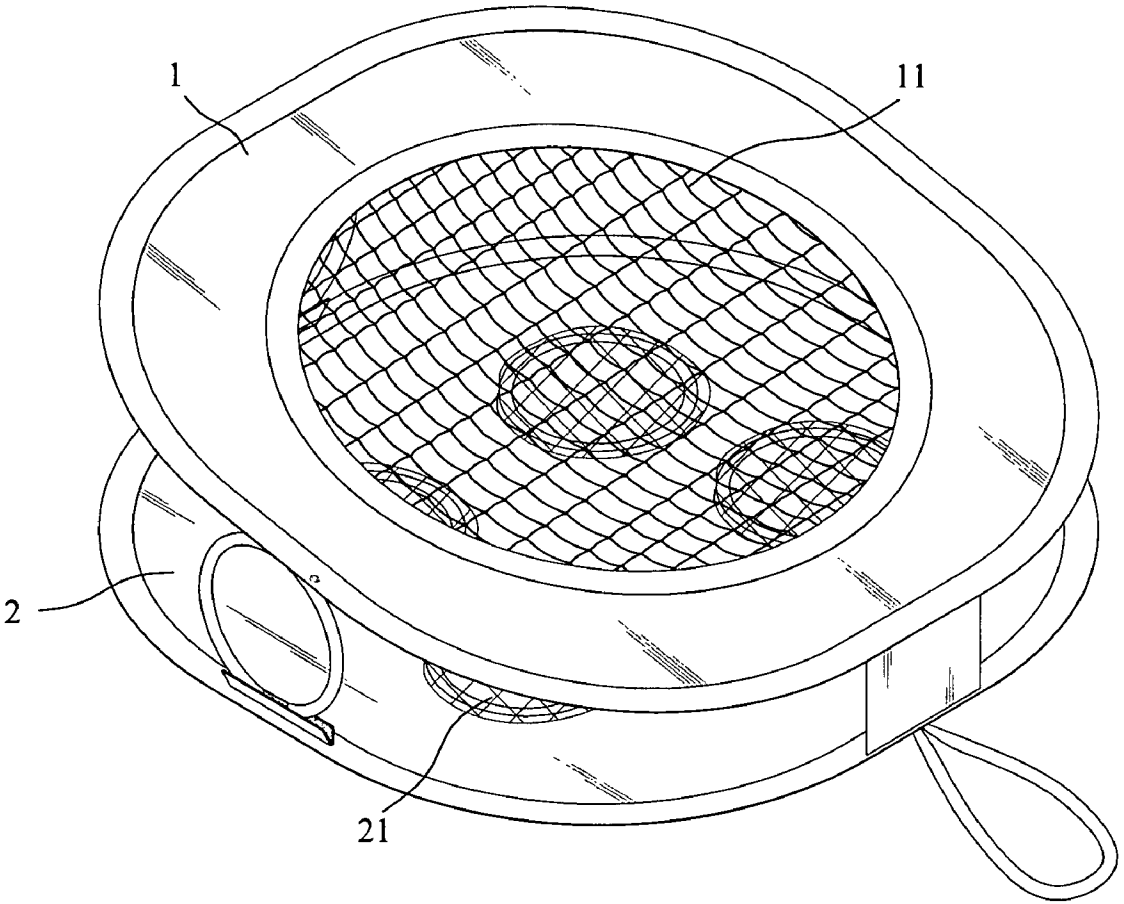
FIG. 1 shows a schematic three-dimensional view of a foldable toss game assembly according to the invention.
Figure 2:
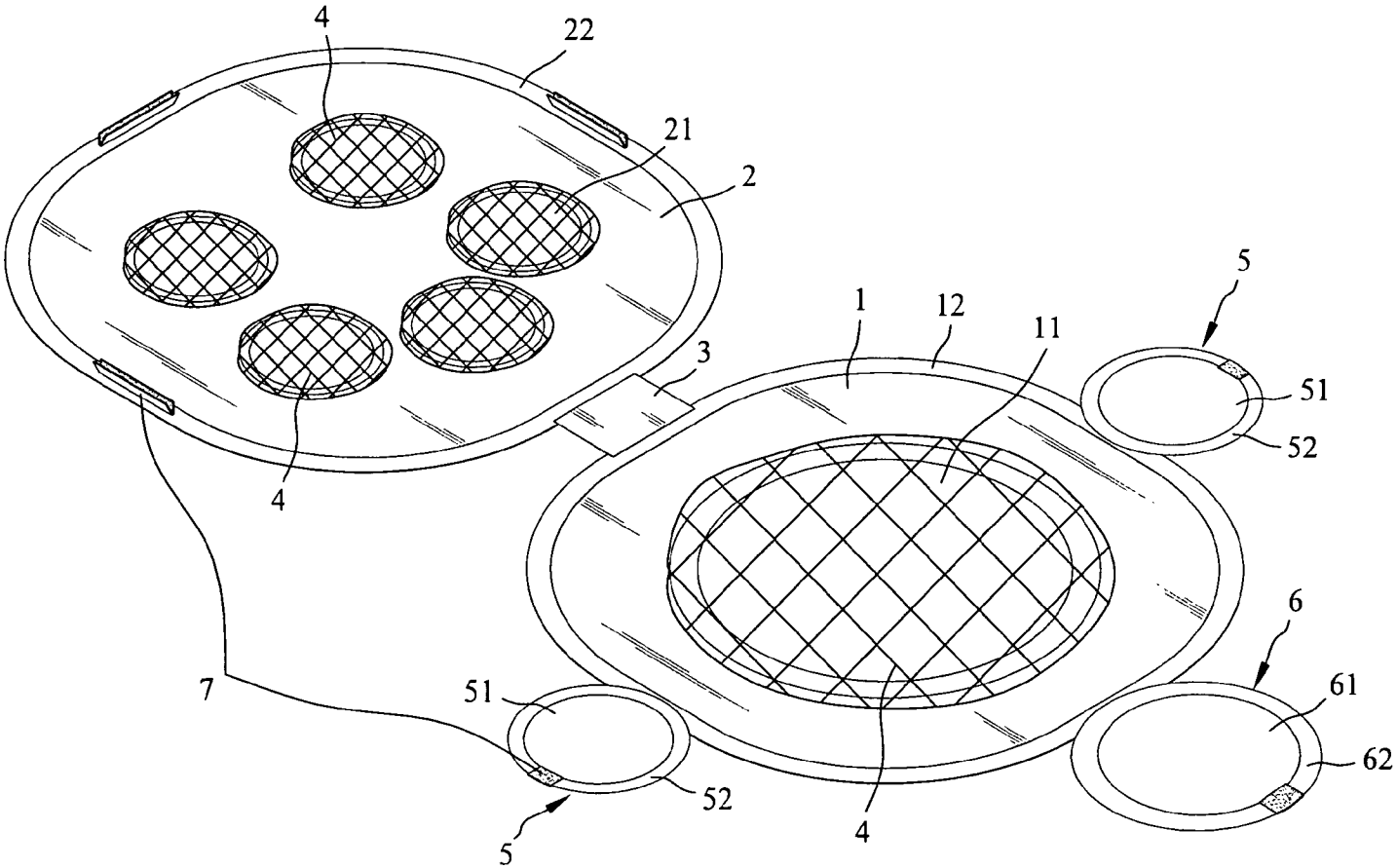
FIG. 2 shows a schematic view of the foldable toss game assembly prior to setting up according to the present invention.

FIG. 1 shows a schematic three-dimensional view of the foldable toss game assembly of the present invention, including two toss surfaces 1, 2, with each toss surface 1, 2 having at least a toss target area 11, 21, respectively. FIG. 2 shows a schematic view of the foldable toss game assembly prior to setting up according to the present invention. Each toss surface 1, 2 is a made of plastic cloth cut in the shape of rectangles with rounded corners, approximating a round shape. The border of toss surface 1, 2 is stitched to wrap a memory ring 12, 22 made of resilient bendable material, respectively. The shape of toss surface 1, 2 is not limited to any specific shape. A connection surface 3 is stitched between toss surfaces 1, 2. Toss surface 1 includes a circular toss target area 11 at the center. Toss target area 11 is surrounded with a stitched surrounding net 4 for catching a tossed object. Toss surface 2 includes five circular toss target areas 21, with each toss target area 21 also surrounded with a stitched surrounding net 4. The number, shapes and the locations of the present invention are not limited to any specification. A plurality of connection parts is stitched to the border of toss surface 1. Two symmetric sides of toss surface 1 include a first connection part 5 respectively. First connection part 5 includes a cloth surface 51 with its border stitched to wrap a memory ring 52. A remaining side of toss surface 1 includes a second connection part 6 with its outer diameter larger than first connection part 5. Second connection 6 includes a cloth surface 61 with its border stitched to wrap a memory ring 62. The free end of first connection part 5 and second connection part 6, and the stitched part of memory ring 22 of toss surface 2 includes a plurality of connection structures 7. For example, in the present embodiment, the connection structure is a touch fastener tape having the fur part located at the free ends of first connection part 5 and second connection part 6, and the claw part attached to the corresponding location on toss surface 2. When setting up foldable toss game assembly, the free ends of first connection part 5 and second connection part 6 are flipped to the position perpendicular to toss surface 1 so that the fur part of the touch fastener tape is fastened to the corresponding claw par on toss surface 2 to form the three-dimensional structure of FIG. 1. Because the outer diameters of first connection part 5 and second connection part 6 are different, and the width of connection surface 3 is smaller than second connection part 5, the side of toss surfaces 1, 2 in the three-dimensional structure shows two symmetric slanted toss surfaces with toss surface 1 supported by the first connection part 5 and two second connection parts 6 above toss surface 2.

Figure 3:
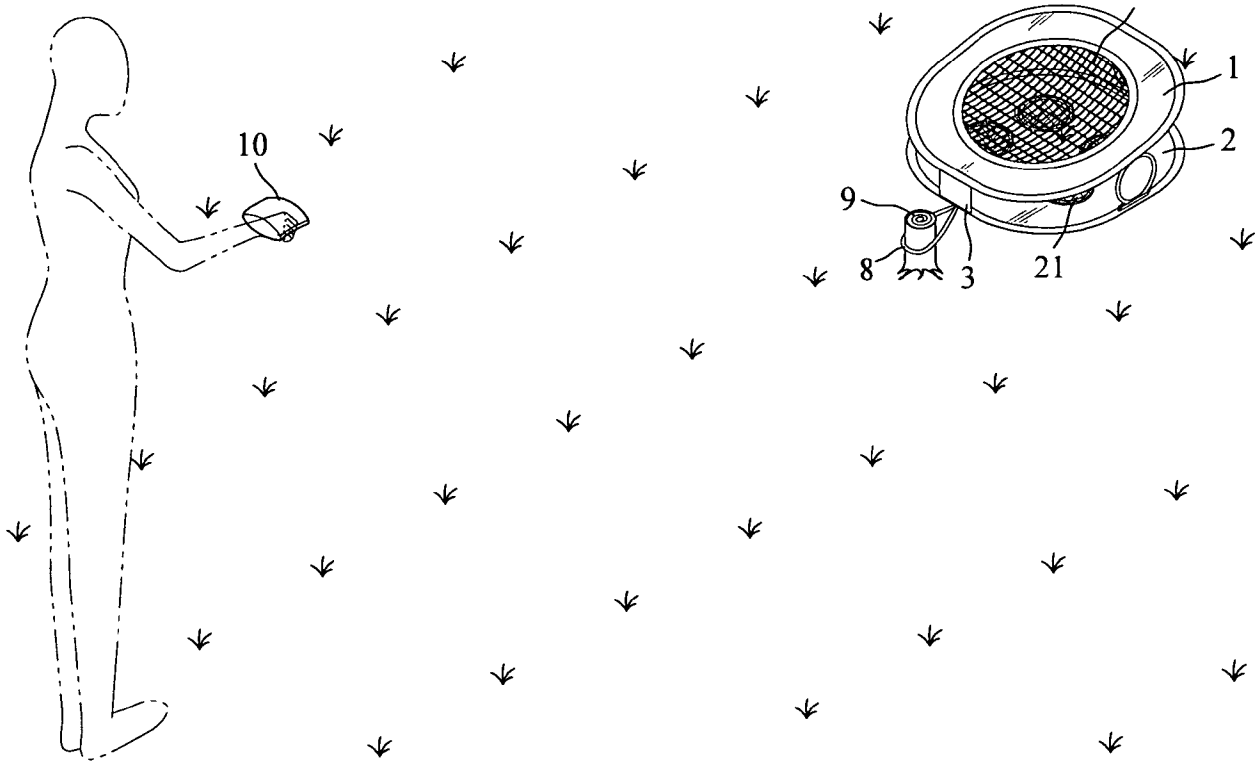
FIG. 3 shows a schematic view of the foldable toss game assembly in use according to the present invention.

FIG. 3 shows a schematic view of the foldable toss game assembly in use according to the present invention. The present invention can be used for single-point tossing practice or multi-point tossing practice. The following uses single-point tossing as an example, and hence toss surface 2 with five toss target areas 21 is placed facing down as the bottom, and the present invention is placed on the ground, with connection surface 3 turned to face the player. In the present embodiment, an anchoring loop 8 made of elastic band is attached to connection surface 3. Anchoring loop 8 can be used to loop a fixed item 9 on the ground, such as a tree or a trunk of plant, to prevent the toss game assembly of the present invention from nudging over or shifting when impacted by a toss object 10. The player may stand at a fixed location to toss object 10 into toss target area 11 for aiming practice. Tossed object 10 can be sand bags, balls, or other objects. In addition, scores (not shown) may be printed next to toss target areas 11, 21 to indicate the score for competition purpose.

Figure 4:
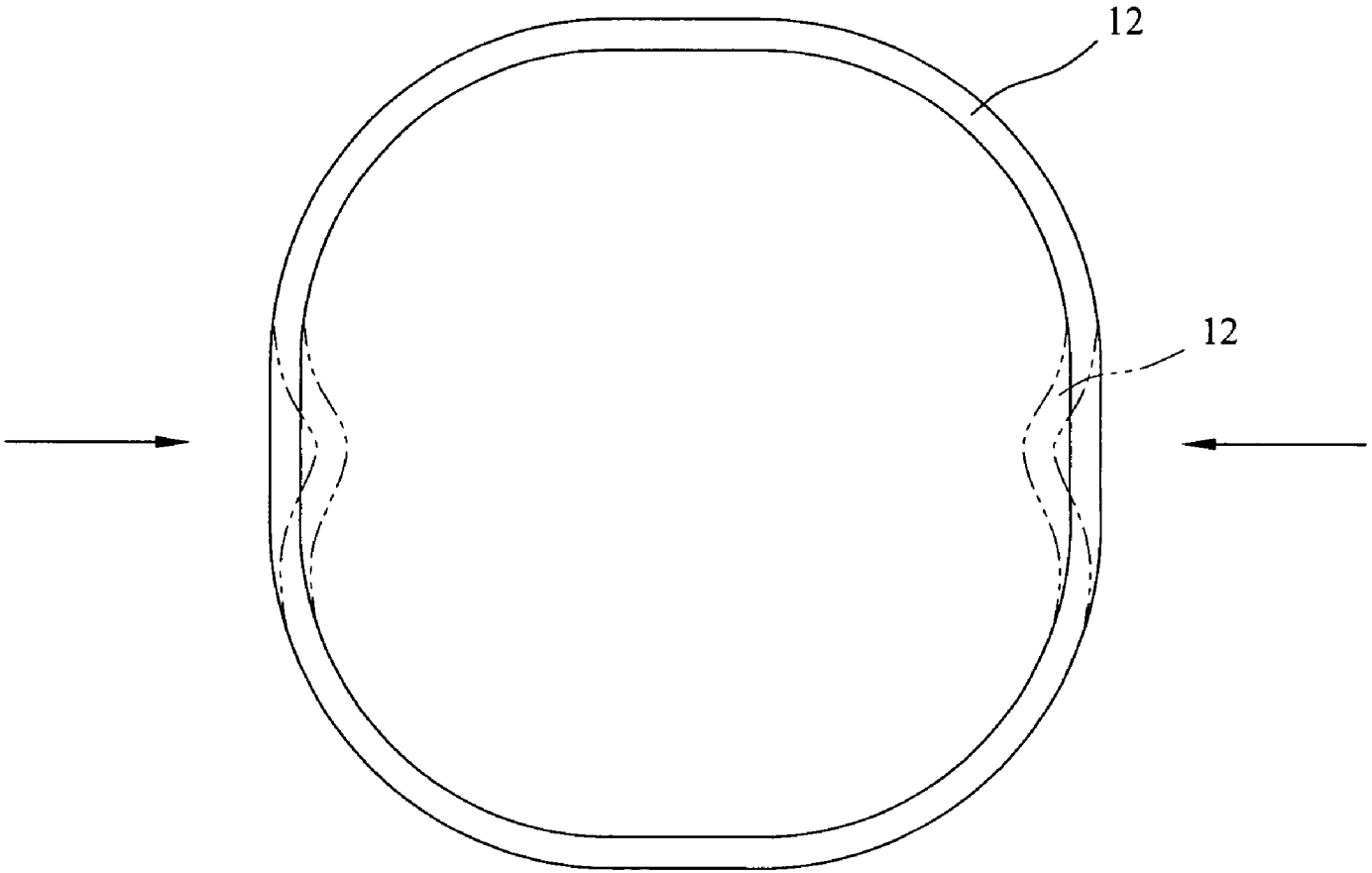
FIG. 4 shows a schematic view of pressing two overlapped toss surfaces inwards from two sides, showing the memory rings being pressed.
Figure 5:
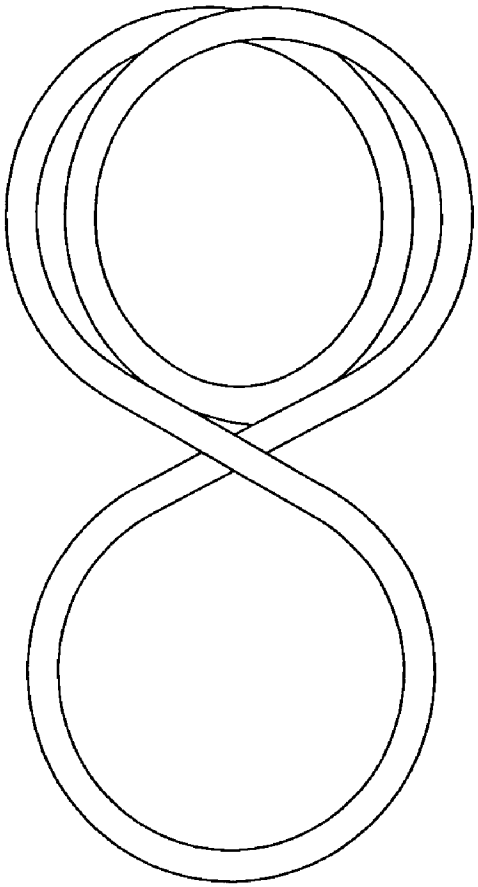
FIG. 5 shows a schematic view of folded memory rings in a form of two overlapped rings and a third ring.
Figure 6:
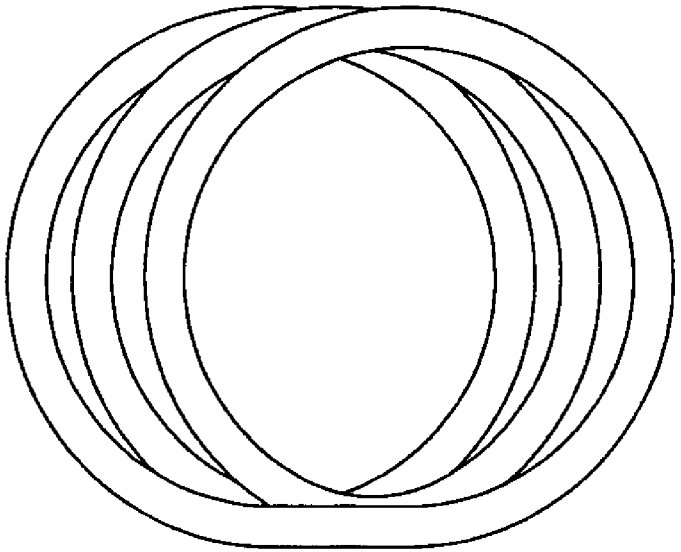
FIG. 6 shows a schematic view of a foldable toss game assembly after being completely folded according to the present invention.

Refer to FIGS. 2, 4, 5 and 6, where FIGS. 4-6 show the views of folding the toss game assembly of the present invention. When not in use, the fur part attached to the free ends of first connection part 5 and second connection part 6 is disengaged from the claw part attached to toss surface 2. With toss surfaces 1, 2 overlapped, two hands hold at the mid-pints of the sides of toss surfaces 1, 2. Both hands close in to the center (shown as the arrow of FIG. 5, FIGS. 4, 6 only showing the shape of the memory rings after folded). Twist the wrist of one hand to form two rings and overlap the two rings. The automatically formed third ring at the bottom is folded to overlap the first two rings to accomplish the folding process. The folded toss game assembly can be placed inside a handbag for easy portability.

The foldable toss game assembly of the present invention includes two toss surfaces, provides more varieties of games, and is light in weight and easy to carrying and storage.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A foldable toss game assembly comprising:

a first toss surface having a memory ring wrapped on a border and at least a toss target area formed on said first toss surface;

a second toss surface having a memory ring wrapped on a border and at least a toss target area formed on said second toss surface;

a connection surface connecting said first and second toss surfaces;

a first circular connection member connecting said first and second toss surfaces; and two second circular connection members connecting said first and second toss surfaces, each of said two second circular connection members having an outer diameter with a size different from the size of the outer diameter of said first circular connection member;

wherein said connection surface, said first circular connection member, and said second circular connection members are disposed around the borders of said first and second toss surfaces to form a three-dimensional structure with said first toss surface being slanted and supported by said first and second circular connection members above said second toss surface because of the different sizes of the outer diameters of said first and second circular connection members.

2. The foldable toss game assembly as claimed in claim 1, wherein said first toss surface has one toss target area and said second toss surface has five toss target areas.

3. The foldable toss game assembly as claimed in claim 1, wherein each of said first and second circular connection members comprises a circular surface made of plastic cloth with a memory ring on a border of said circular surface.

4. The foldable toss game assembly as claimed in claim 1, wherein each of said first and second circular connection members has a first side fixed to said first toss surface and a second side connected to said second toss surface with a connection structure.

5. The foldable toss game assembly as claimed in claim 4, wherein said connection structure is a touch fastener tape with a fur part and a claw part.

6. The foldable toss game assembly as claimed in claim 1, wherein each of the toss target areas is surrounded by a surrounding net to catch a tossed object.

7. The foldable toss game assembly as claimed in claim 1, wherein each of said first and second toss surfaces is made of plastic cloth.

8. The foldable toss game assembly as claimed in claim 1, wherein said connection surface has an anchoring loop for looping a fixed object to prevent said foldable toss game assembly from moving by an external force.

* * * * *